US006098933A

United States Patent [19]

Stein

[11] Patent Number: 6,098,933

[45] Date of Patent: Aug. 8, 2000

[54] LITTER BAG HANGER

[76] Inventor: Roger A. Stein, 3944-15th St. South, Fargo, N. Dak. 58104

[21] Appl. No.: 09/304,363

[22] Filed: May 4, 1999

[51] Int. Cl.[7] ..... B65B 67/04

[52] U.S. Cl. ..... 248/99; D9/434

[58] Field of Search ..... 248/95, 97, 100, 248/101; 294/158, 159, 153, 165; 53/384, 390; 141/316, 390, 391; 222/102; 16/124

[56] References Cited

U.S. PATENT DOCUMENTS

| | | | |
|---|---|---|---|
| D. 294,559 | 3/1988 | Schwalbach | D9/434 |
| D. 303,348 | 9/1989 | Hix | D9/434 |
| D. 340,863 | 11/1993 | Daigle | D9/434 |
| 1,498,247 | 6/1924 | Stewart | 294/146 |
| 3,912,208 | 10/1975 | Grenetier | 248/101 |
| 4,695,020 | 9/1987 | Collins | 248/95 |
| 4,881,706 | 11/1989 | Sedlik | 248/99 |
| 4,923,235 | 5/1990 | Stewart | 294/141 |
| 4,984,759 | 1/1991 | Perlant | 248/99 |
| 5,029,926 | 7/1991 | Dieterich | 294/171 |
| 5,160,103 | 11/1992 | Breitenstein | 248/100 |
| 5,222,702 | 6/1993 | Olmos | 248/100 |
| 5,639,051 | 6/1997 | Surbeck | 248/100 |

FOREIGN PATENT DOCUMENTS

| | | | |
|---|---|---|---|
| 27 11 443 | 9/1977 | Germany | 248/101 |

*Primary Examiner*—Anita M. King
*Assistant Examiner*—Michael Nornberg

[57] ABSTRACT

A litter bag hanger for supporting a conventional plastic bag in an open position within a vehicle or under other structures. The inventive device includes a base member, an adhesive strip attached to the upper surface of the base member, a first arm extending from the base member, a pair of first notches within the first arm, a second arm extending from the base member, and a pair of second notches within the second arm. The first notches and the second notches are pear shaped with the narrow end within the perimeter of the first arm and second arm respectively. The first notches and the second notches receive the bag handles of the plastic bag thereby supporting it in a substantially open position. The adhesive strip is attachable to the under surface of a dashboard, countertop, desk, cabinet, or table. The first arm and the second arm are angled downwardly from the base member for allowing easy attachment and removal of the bag handles from the first notches and second notches.

1 Claim, 4 Drawing Sheets

LITTER BAG HANGER

BACKGROUND OF THE INVENTION

1. Field of the Invention

The present invention relates generally to bag holding devices and more specifically it relates to a litter bag hanger for supporting a conventional plastic bag in an open position within a vehicle.

Often times while operating a vehicle such as an automobile or tractor, the use will accumulate a significant amount of trash. The user generally will attempt to position the trash in a single location within the vehicle, however the trash will generally move about the entire vehicle during travel of the vehicle. Sometimes the user will have a plastic bag positioned within the vehicle. However, the user must attempt to simultaneously support the bag in an open position while inserting the trash into the bag. This is not only inconvenient but also extremely dangerous to the driver and others. Hence, there is a need for a device that supports a conventional plastic bag within a vehicle for allowing easy insertion of garbage by an individual.

2. Description of the Prior Art

Bag supporting devices have been in use for years. Typically, a plastic bag supporting device comprises a base and a pair of arms extending upwardly therefrom as commonly found in grocery stores. These bag supporting devices are suitable for utilization in spacious areas, however they are not as desirable for utilization in smaller areas such as an automobile.

Examples of other bag supporting devices include U.S. Pat. No. 5,160,103 to Breitenstein; U.S. Pat. No. 5,222,702 to Olmos; U.S. Pat. No. 4,997,149 to Koch; U.S. Pat. No. 5,639,051 to Surbeck; U.S. Pat. No. 5,062,533 to Fickes et al.; U.S. Pat. No. 4,838,504 to Bittenbinder; U.S. Pat. No. 5,246,190 to Swirkal; U.S. Pat. No. 5,362,153 to Lu which are all illustrative of such prior art.

Bittenbinder (U.S. Pat. No. 4,838,504) discloses a bag-holding article. Bittenbinder teaches a base member attachable to a vertically-orientated flat surface and two bag-supporting arms extending at opposing ends of the base member for supporting a bag having at least two loops.

Koch (U.S. Pat. No. 4,997,149) discloses a plastic bag support. Koch teaches a plastic strip having outwardly projecting ears for hooking over a trash container.

While these devices may be suitable for the particular purpose to which they address, they are not as suitable for supporting a conventional plastic bag in an open position within a vehicle. Conventional bag support devices are not capable of being utilized within small areas such as on a vehicle.

In these respects, the litter bag hanger according to the present invention substantially departs from the conventional concepts and designs of the prior art, and in so doing provides an apparatus primarily developed for the purpose of supporting a conventional plastic bag in an open position within a vehicle.

SUMMARY OF THE INVENTION

In view of the foregoing disadvantages inherent in the known types of bag support devices now present in the prior art, the present invention provides a new litter bag hanger construction wherein the same can be utilized for supporting a conventional plastic bag in an open position within a vehicle.

The general purpose of the present invention, which will be described subsequently in greater detail, is to provide a new litter bag hanger that has many of the advantages of the bag supporting devices mentioned heretofore and many novel features that result in a new litter bag hanger which is not anticipated, rendered obvious, suggested, or even implied by any of the prior art bag supporting devices, either alone or in any combination thereof.

To attain this, the present invention generally comprises a base member, an adhesive strip attached to the upper surface of the base member, a first arm extending from the base member, a pair of first notches within the first arm, a second arm extending from the base member, and a pair of second notches within the second arm. The first notches and the second notches are pear shaped with the narrow end within the perimeter of the first arm and second arm respectively. The first notches and the second notches receive the bag handles of the plastic bag thereby supporting it in a substantially open position. The adhesive strip is attachable to the under surface of a dashboard, countertop, desk, cabinet, or table. The first arm and the second arm are angled downwardly from the base member for allowing easy attachment and removal of the bag handles from the first notches and second notches.

There has thus been outlined, rather broadly, the more important features of the invention in order that the detailed description thereof may be better understood, and in order that the present contribution to the art may be better appreciated. There are additional features of the invention that will be described hereinafter and that will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of the description and should not be regarded as limiting.

A primary object of the present invention is to provide a litter bag hanger that will overcome the shortcomings of the prior art devices.

Another object is to provide a litter bag hanger that supports a plastic bag with two bag handles in an open position.

An additional object is to provide a litter bag hanger that is mountable within relatively small areas such as below a dashboard of a vehicle.

A further object is to provide a litter bag hanger that is of a flat design so as to not interfere with the operation of a vehicle during nonuse.

Another object is to provide a litter bag hanger that can be utilized under sinks, tables, desks and counter tops.

A further object is to provide a litter bag hanger that utilizes less space than a conventional trash can.

Other objects and advantages of the present invention will become obvious to the reader and it is intended that these objects and advantages are within the scope of the present invention.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DESCRIPTION OF THE PREFERRED EMBODIMENT

Figure 1:
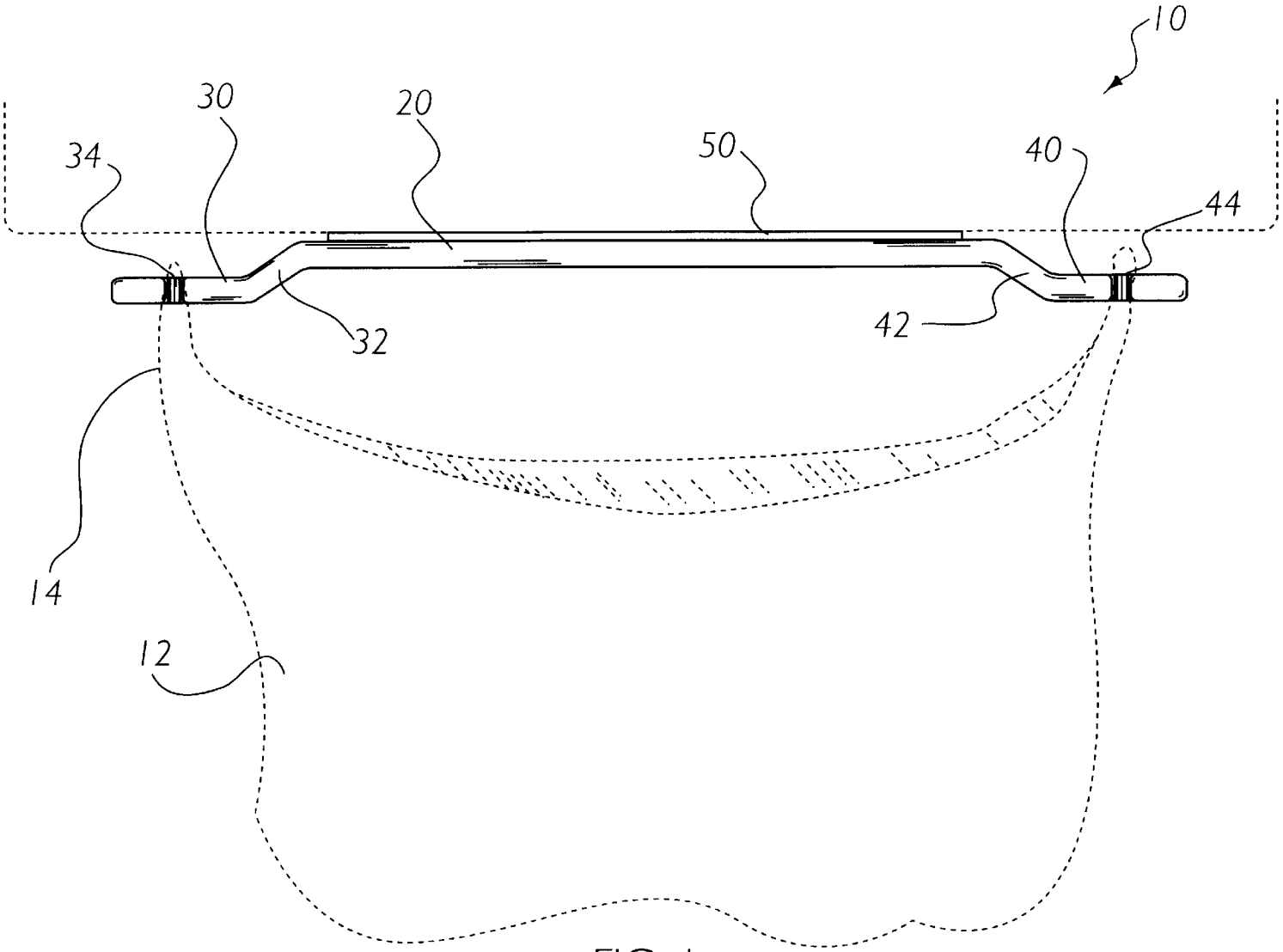
FIG. 1 is a side view of the present invention with a plastic bag attached.

Turning now descriptively to the drawings, in which similar reference characters denote similar elements throughout the several view, FIGS. 1 through 4 illustrate a litter bag hanger 10, which comprises a base member 20, an adhesive strip 50 attached to the upper surface of the base member 20, a first arm 30 extending from the base member 20, a pair of first notches 34 within the first arm 30, a second arm 40 extending from the base member 20, and a pair of second notches 44 within the second arm 40. The first notches 34 and the second notches 44 are pear shaped with the narrow end within the perimeter of the first arm 30 and second arm 40 respectively. The first notches 34 and the second notches 44 receive the bag handles 14 of the plastic bag 12 thereby supporting it in a substantially open position. The adhesive strip 50 is attachable to the under surface of a dashboard, countertop, desk, cabinet, or table. The first arm 30 and the second arm 40 are angled downwardly from the base member 20 for allowing easy attachment and removal of the bag handles 14 from the first notches 34 and second notches 44.

Figure 2:
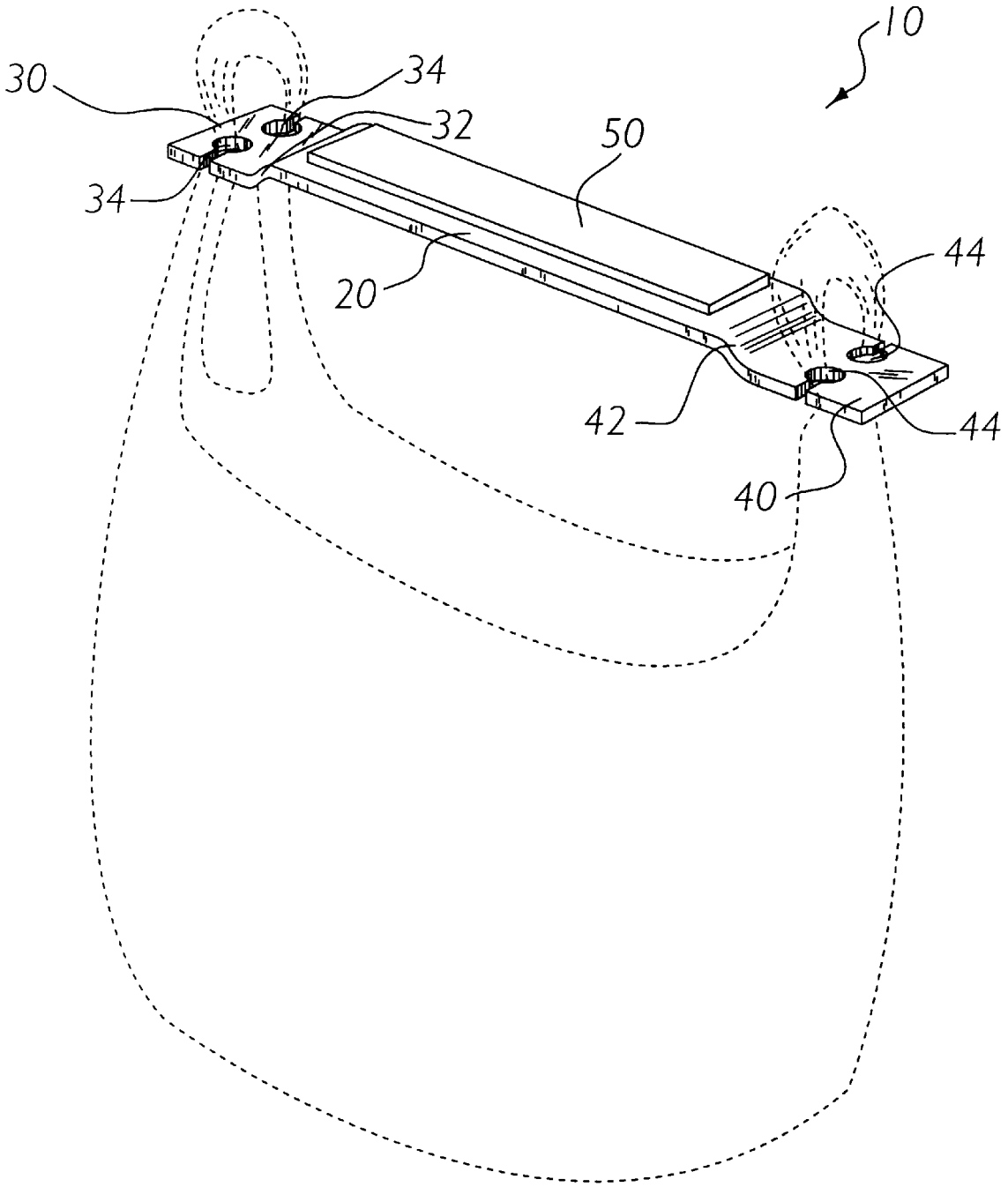
FIG. 2 is an upper perspective view of the present invention with a plastic bag attached.
Figure 3:
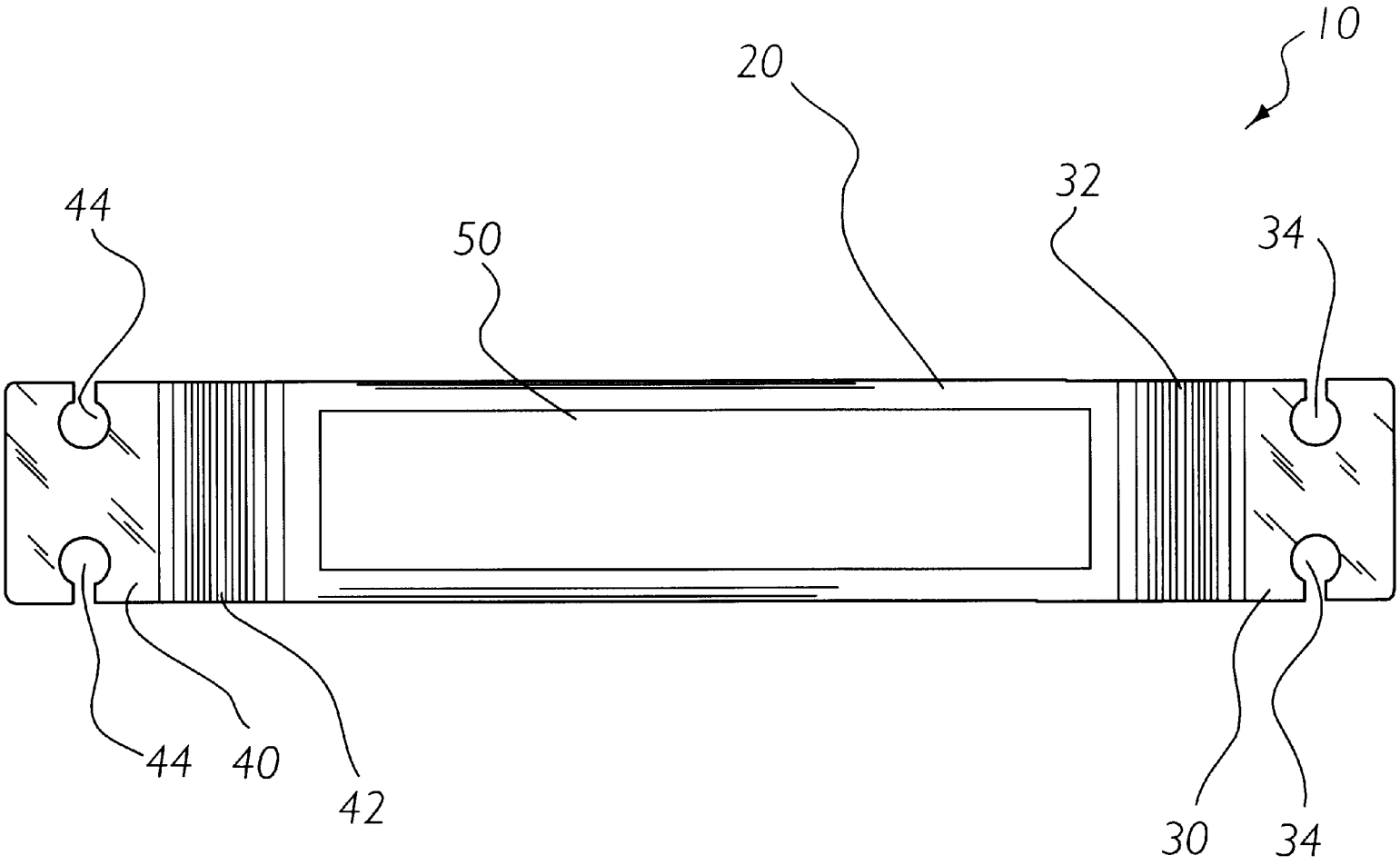
FIG. 3 is a top view of the present invention.
Figure 4:
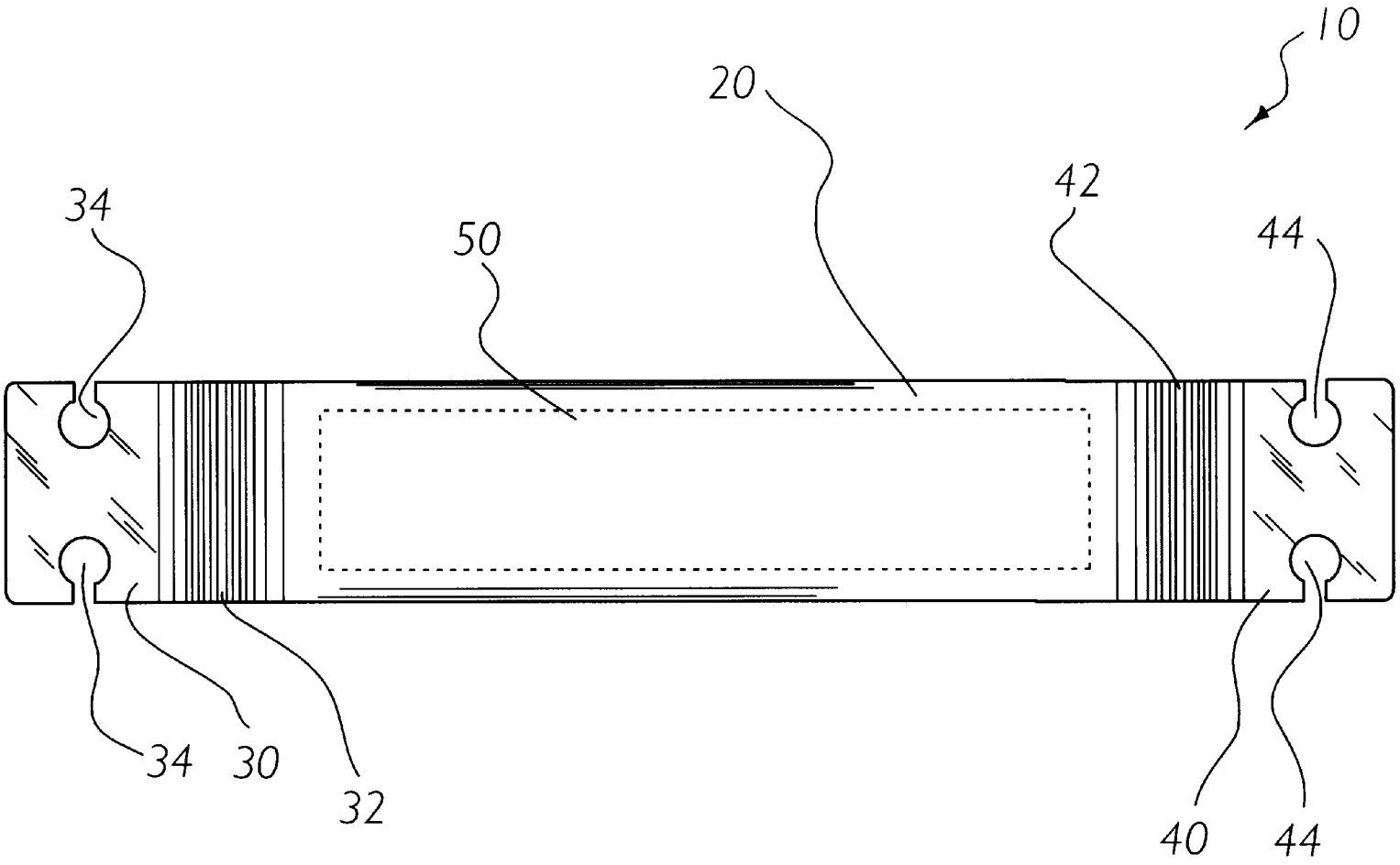
FIG. 4 is a bottom view of the present invention.

As shown in FIG. 1 of the drawings, the base member 20 is preferably a flat and elongated structure. As shown in FIG. 4 of the drawings, the base member 20 preferably is comprised of an elongated rectangular shape, however it can be appreciated by one skilled in the art that various other shapes may be utilized. As best shown in FIGS. 2 and 3 of the drawings, a length of adhesive strip 50 is attached to the top surface of the base member 20 for attaching to the under surface of an object.

As best shown in FIGS. 1 and 2 of the drawings, the first arm 30 is attached to the distal end of the base member 20. The first arm 30 has a first angled portion 32 as best shown in FIG. 1. The first arm 30 is preferably parallel to the base member 20 as shown in FIG. 1 of the drawings.

As best shown in FIGS. 1 and 2 of the drawings, the second arm 40 is attached to the distal end of the base member 20 opposite of the first arm 30. The second arm 40 has a second angled portion 42 as best shown in FIG. 1. The second arm 40 is preferably parallel to the base member 20 as shown in FIG. 1 of the drawings.

As best shown in FIGS. 2 through 4 of the drawings, the first arm 30 includes a pair of opposing first notches 34. The pair of first notches 34 are preferably pear shaped with the narrow end exposed through the perimeter of the first arm 30. The pair of first notches 34 receive and retain one of the bag handles 14 of the plastic bag 12 as shown in FIGS. 1 and 2 of the drawings.

As best shown in FIGS. 2 through 4 of the drawings, the second arm 40 includes a pair of opposing second notches 44. The pair of second notches 44 are preferably pear shaped with the narrow end exposed through the perimeter of the second arm 40. The pair of second notches 44 receive and retain one of the bag handles 14 of the plastic bag 12 as shown in FIGS. 1 and 2 of the drawings.

In use, the user removes the protective cover from the adhesive strip 50 and secures the base member 20 to the lower surface of an object such as a dashboard of a vehicle. The user then positions the bag handles 14 of the plastic bag 12 within the first notches 34 and the second notches 44 where they are supported upwardly with the plastic bag 12 in an open position. The user then may insert trash and other debris into the plastic bag 12. After the plastic bag 12 is full, the user simply removes the bag handles 14 from the first notches 34 and the second notches 44 thereafter disposing of the bag in a desirable location.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

Index of Elements for Automobile Litter Bag Hanger

ENVIRONMENTAL ELEMENTS

10. Automobile Litter Bag Hanger
11.
12. Plastic Bag
13.
14. Bag Handles
15.
16.
17.
18.
19.
20. Base Member
21.
22.
23.
24.
25.
26.
27.
28.
29.
30. First Arm
31.
32. First Angled Portion
33.
34. First Notches
35.
36.
37.
38.

-continued

| Index of Elements for Automobile Litter Bag Hanger |
| --- |
| ENVIRONMENTAL ELEMENTS |
| 39. |
| 40. Second Arm |
| 41. |
| 42. Second Angled Portion |
| 43. |
| 44. Second Notches |
| 45. |
| 46. |
| 47. |
| 48. |
| 49. |
| 50. Adhesive Strip |
| 51. |
| 52. |
| 53. |
| 54. |
| 55. |
| 56. |
| 57. |
| 58. |
| 59. |
| 60. |
| 61. |
| 62. |
| 63. |
| 64. |
| 65. |
| 66. |
| 67. |
| 68. |
| 69. |
| 70. |
| 71. |
| 72. |
| 73. |
| 74. |
| 75. |
| 76. |
| 77. |
| 78. |
| 79. |

I claim:

1. A litter bag holder in combination with an automobile interior surface, the litter bag holder comprising:

a rectangular-shaped base member (20) comprising a flat structure having first and second ends defined by a width dimension; two longitudinal sides defined by a length dimension; an upper surface and lower surface having no holes or openings therethrough; and a side profile defined by a thickness dimension;

a first arm (30) having a first flat portion connected to a first angled portion (32) projecting downwardly and outwardly from the first end of said base member as viewed from the side profile of said base member;

a second arm (40) having a second flat portion connected to a second angled portion (42) projecting downwardly and outwardly from the second end of said base member as viewed from the side profile of said base member;

wherein said thickness dimension of said base member is substantially thin as compared to the width dimension of said first and second end;

wherein said first flat portion of said first arm and said second flat portion of said second arm lie within a first plane and wherein said base member lies within a second plane relative to said first plane that is substantially parallel to said first plane but not within a plane common to both said first and second planes;

a means for securing the upper surface of said base member to said automobile interior supporting surface comprising an adhesive strip (50) secured to said upper surface of said member;

a first pair (34) and second pair (44) of bag receiving notches located on said respective first and second flat portions of said first and second arms, said bag receiving notches being adapted to securely hold a bag;

wherein said bag receiving notches consist of a narrow insertion portion which forms a gap and circular-shaped receiving portion having a diameter approximately twice the width of the gap;

wherein the narrow insertion portion consists of two opposing parallel sides connected to said circular-shaped receiving portion, wherein said narrow insertion portion of each said bag receiving notch are located on the longitudinal sides of said base member.

* * * * *